US008303361B2

(12) United States Patent
Green

(10) Patent No.: US 8,303,361 B2
(45) Date of Patent: Nov. 6, 2012

(54) FLOATATION DEVICE FOR A PREGNANT WOMAN

(75) Inventor: Gina Green, Woodbury, MN (US)

(73) Assignee: Bellyflopz, LLC, Woodbury, MN (US)

( * ) Notice: Subject to any disclaimer, the term of this patent is extended or adjusted under 35 U.S.C. 154(b) by 155 days.

(21) Appl. No.: 12/822,388

(22) Filed: Jun. 24, 2010

(65) Prior Publication Data

US 2011/0081815 A1 Apr. 7, 2011

Related U.S. Application Data

(60) Provisional application No. 61/219,843, filed on Jun. 24, 2009.

(51) Int. Cl.
*B63C 9/30* (2006.01)
*B63C 9/28* (2006.01)

(52) U.S. Cl. ..... 441/129

(58) Field of Classification Search ..... 441/35, 441/40–54, 65–67, 74, 79, 80, 88, 129–131, 441/135, 136; 5/631, 735, 710, 722; 601/11
See application file for complete search history.

(56) References Cited

U.S. PATENT DOCUMENTS 3,378,862 A * 4/1968 Skinner ..... 5/722
3,988,793 A * 11/1976 Abitbol ..... 601/11
4,021,872 A * 5/1977 Powell ..... 5/722
4,054,960 A * 10/1977 Pettit et al. ..... 5/631
4,382,306 A * 5/1983 Lickert ..... 5/710
4,489,452 A * 12/1984 Lickert ..... 5/710
4,737,999 A * 4/1988 Halverson ..... 5/710
4,819,287 A * 4/1989 Halverson ..... 5/710
5,185,897 A * 2/1993 Van Laanen ..... 5/710
D335,999 S * 6/1993 Van Driessche ..... D6/604
D350,586 S * 9/1994 Francis ..... D21/809
5,679,040 A * 10/1997 Bianchi-Holm ..... 441/129
D392,145 S * 3/1998 Thurston ..... D6/604
5,890,246 A * 4/1999 Davis ..... 5/735
6,233,768 B1 5/2001 Harding
6,568,015 B1 * 5/2003 Allen ..... 5/735
6,761,604 B1 7/2004 Hronek
6,959,464 B2 11/2005 Fahey
7,127,764 B1 10/2006 Harding et al.

* cited by examiner

*Primary Examiner* — Daniel Venne

(74) *Attorney, Agent, or Firm* — Fredrikson & Byron, PA

(57) ABSTRACT

A floatation device for a pregnant woman is formed from a panels of an air impermeable material defining an inflatable chamber having an abdomen cavity passing there through to allow a pregnant woman rest on the floatation device while lying in a prone position. The unique torso cavity shape and cover encasing the chamber functionally combine to provide the woman an improved level of comfort when using the device. Internal structural support features, handles, and appropriate device dimensions can further combine to increase the level of comfort provided to the user.

13 Claims, 3 Drawing Sheets

FLOATATION DEVICE FOR A PREGNANT WOMAN

RELATED APPLICATIONS

This application claims priority to U.S. Provisional Patent Application Ser. No. 61/219,843, filed Jun. 24, 2009, and titled "Floatation Device for a Pregnant Woman," the contents of which is hereby incorporated by reference.

FIELD OF THE INVENTION

The present invention generally relates to inflatable floatation devices. More specifically, the present invention relates to floatation devices for a pregnant woman.

BACKGROUND

It is well known that during the natural progression of pregnancy, a woman's expanding abdomen can cause her a large amount of discomfort. The added weight of the enlarging abdomen can often cause significant back and leg stress for the woman. Many pregnant women have found floating in water to alleviate much of the stress associated with carrying a child to term. However, traditional floatation devices or rafts are generally not built to accommodate the expanded abdomen of a pregnant woman, so a pregnant woman seeking to rest on a floatation device in the water must rest on her back or upright.

SUMMARY

Floatation devices according to the invention include an inflatable chamber including an ergonomically shaped abdomen cavity extending through the chamber. The abdomen cavity is generally ovate, having a broad base end and tapering toward a narrower tapered end oriented toward the front of the chamber. In some embodiments, the abdomen cavity is centered relative to the sides of the chamber and slightly forward of the lengthwise center of the raft. Embodiments can include a cover comprising a skin-friendly material encasing the chamber. A cover can present a soft, smooth surface to the user so that skin irritation and chaffing are reduced. Some embodiments include internal support structures to contour the device. Embodiments can be sized to accommodate a single user and can further include handles located on its sides.

Embodiments of the invention allow a pregnant user to lie in a prone position on the device while floating in water. Moreover, the device can provide the user an increased level of comfort while doing so. For example, the ergonomically designed abdomen cavity can provide decreased raft-skin irritation associated with chaffing and rubbing of the edges of the abdomen cavity against the extended abdomen when boarding or moving the floatation device in water. This decreased chaffing can be accomplished while preventing the feeling of slipping through the device. Further, embodiments can be sized and include handles providing for easy transportability by providing the features in as compact a device as possible so pregnant women can easily carry the device.

Ultimately, the combined features of embodiments of the present invention provide a pregnant user with a floatation device that addresses and overcomes discomfort and transportability issues associated with other floatation devices known in the art.

BRIEF DESCRIPTION OF THE DRAWINGS

The following drawings are illustrative of particular embodiments of the invention and therefore do not limit the scope of the invention. The drawings are not to scale (unless so stated) and are intended for use in conjunction with the explanations in the following detailed description. Embodiments of the invention will hereinafter be described in conjunction with the appended drawings, wherein like numerals denote like elements.

DETAILED DESCRIPTION OF THE DRAWINGS

Figure 1:
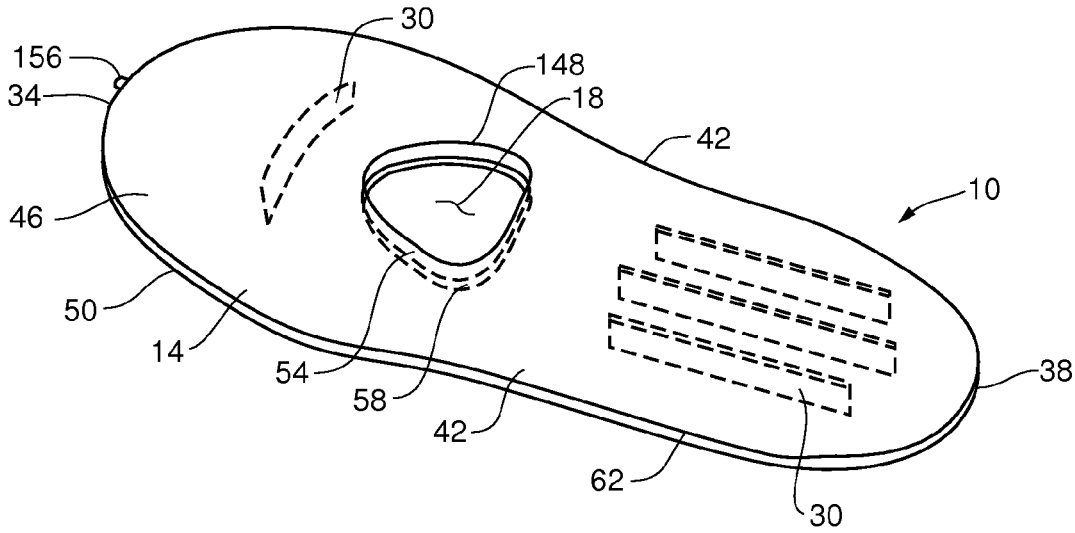
FIG. 1 is a perspective view of a chamber according to some embodiments of the invention.

For the purpose of promoting an understanding of the principles of the invention, reference will now be made to the embodiments illustrated in the drawing and specific language will be used to describe the same. It will, nevertheless, be understood that no limitation of the scope of the invention is thereby intended; any alterations and further modifications of the described or illustrated embodiments, and any further applications of the principles of the invention as illustrated therein, are contemplated as would normally occur to one skilled in the art to which the invention relates.

Embodiments of the invention provide an improved comfort floatation device or raft for a pregnant woman. As can be seen by the embodiments in FIGS. 1 and 2, the floatation device 10 includes an inflatable chamber 14 having an abdomen cavity 18 extending through the chamber. The abdomen cavity 18 is ergonomically shaped to receive the extended abdomen of a pregnant woman. Thus, the pregnant user can comfortably lay in a prone position on the floatation device. Embodiments can include other features to enhance the comfort provided to users, in particular pregnant women users. For example, embodiments can further include a cover 22 encasing the chamber 14, handles 26, and internal support structures 30 to provide, in combination, a significantly improved level of comfort to pregnant users. Moreover, some embodiments are particularly sized and shaped so as to provide ease of use for a pregnant user.

The inflatable chamber 14 generally comprises at least one panel of panel material and includes forward and rearward ends 34, 38, sides 42, and upper and lower surfaces. The embodiment of FIG. 1 can be seen to include four panels, two major panels 46, 50 and two cavity panels 54, 58 defining the abdomen cavity 18 which extends through the upper and lower surfaces. Other embodiments can include, for example, one major panel and one cavity panel, two major panels and no cavity panels, more than two major panels, more than two cavity panels, etc. Some embodiments can even include any number of additional side panels to define the sides of the chamber.

Figure 2:
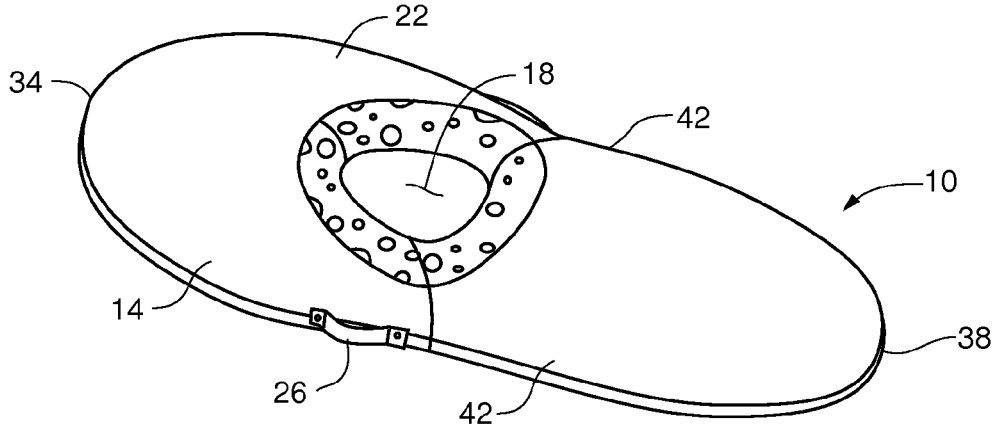
FIG. 2 is a perspective view of an embodiment of the invention including a cover.

In the embodiment of FIG. 1, the major panels include an upper major panel 46 and a lower major panel 50. Upper and lower major panels 46, 50 are joined at a panel seam 62 that, in this embodiment, is positioned along the sides of the chamber. The cavity panels likewise include an upper cavity panel 54 and a lower cavity panel 58, joined to each other at an inner cavity seam. The upper cavity panel 54 can be joined to the upper major panel 46 at an upper cavity seam, and the lower cavity panel 58 can be joined to the lower major panel 50 at a lower cavity seam. Chamber panels should be made from a generally flexible, air impermeable material, such as vinyl, a heavy gauged poly vinyl chloride (PVC), or other plastic sheet material. Panel and cavity seams should be a generally air tight seal, sturdy enough to maintain the integrity of the chamber under increased pressure from inflation and use. For example, in some embodiments, the seams can be formed by stitch, adhesive bond, heat bond, or some combination thereof.

Figure 3:
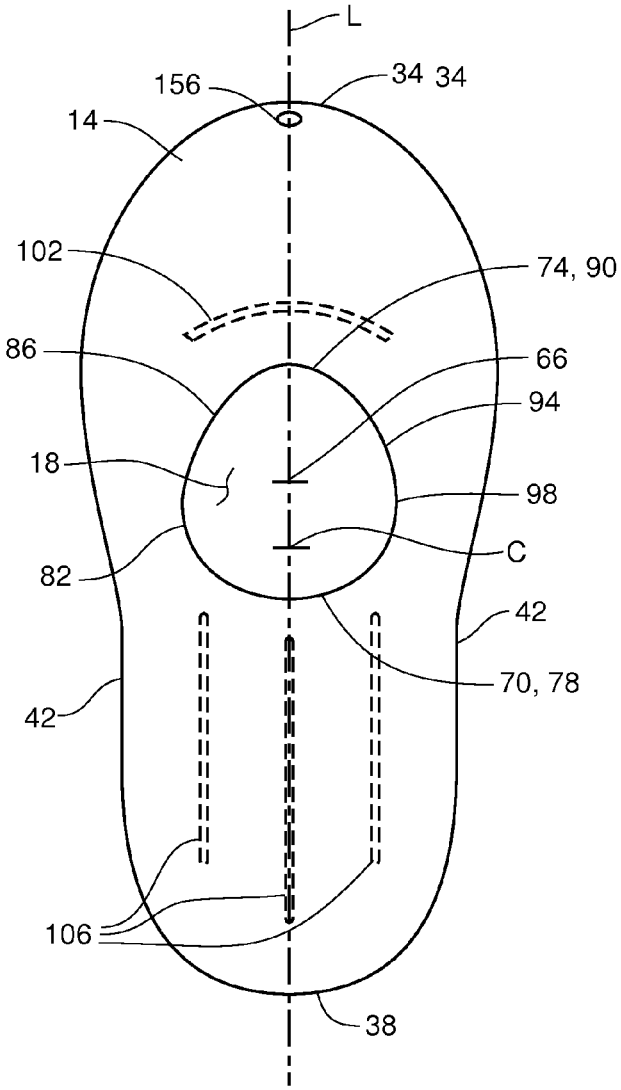
FIG. 3 is a top plan view of an inflated chamber according to some embodiments of the invention.

Referring now to FIG. 3, embodiments of the invention include a chamber 14 having an abdomen cavity 18 that is ergonomically designed to accommodate the extended belly of a pregnant woman and provide a substantially increased level of comfort to the user. The abdomen cavity 18 can be ovate and generally symmetrical about a longitudinal centerline L of the chamber 14. In some embodiments, the geometric center 66 of the abdomen cavity is located centrally relative to the sides 42 and forward of the lengthwise center C of the floatation device. The cavity 18 is not square, circular, or elliptical, but is "egg-shaped," having a broad base end 70 and gradually tapering toward a narrower tapered end 74. In many embodiments, the tapered end is oriented toward the forward end 34 of the inflatable chamber. Both the base and tapered ends 70, 74 can be generally defined by rounded corners and broad, curving sides. It has been found that such a shape better fits a pregnant woman's extended abdomen and can avoid discomfort that may be caused by an otherwise shaped opening.

Another way to describe the abdomen cavity of the invention is as a series of circular arcs having alternating major and minor radii of curvature. For example, the cavity 18 in the embodiment of FIG. 3 includes three major and three minor radius of curvature portions. Starting from the base end 70, i.e. the first major radius portion 78, and traveling clockwise, a first minor radius portion 82 is interposed between the first major radius portion 78 and a second major radius portion 86. A second minor radius portion 90 at the tapered end 74 is interposed between the second major radius portion 86 and a third major radius portion 94. And finally, a third minor radius portion 98 is interposed between the third major radius portion 94 and the first major radius portion 78. Each portion smoothly transitions into the next corresponding portion so that the cavity 18 remains generally rounded and convex. It should be noted that each minor portion can have a unique radius of curvature, two or more of the minor portions can have the same radius of curvature, or all minor portions can have the same radius of curvature. In some embodiments, the first and third minor portions 82, 98 (i.e. those defining the base end 70) have generally the same radius of curvature, with the second minor portion 90 having a smaller radius of curvature. The major radius portions 78, 86, 94 can likewise vary or match each other in radius size.

In some embodiments, the size of the abdominal cavity 18 can have a maximum length dimension (i.e. along the longitudinal centerline 66) of approximately 12 inches to approximately 24 inches, with a maximum width dimension (i.e. transverse to the longitudinal centerline 66) of approximately 12 inches to approximately 24 inches. In a preferred embodiment, the maximum length dimension is approximately 18.5 inches and the maximum width dimension is approximately 17.5 inches.

Figure 4:
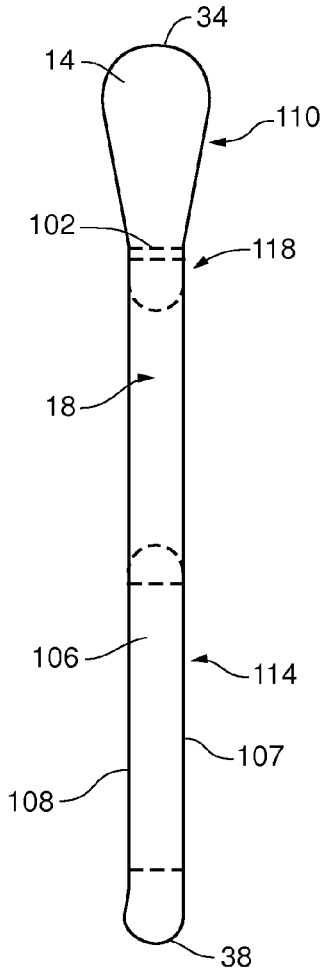
FIG. 4 is a side plan view of an inflated chamber according to some embodiments of the invention.

User comfort can be increased in some embodiments by the inclusion of internal support structures coupled between the upper surface and the lower surface of the chamber. Such structures contour the floatation device and provide shape integrity at predetermined locations. For example, the embodiment of FIGS. 3 and 4 can be seen to include a front baffle 102 and three rearward baffles 106 positioned within the chamber 14. The side section view of FIG. 4 shows the baffles 102, 106 can be coupled on the interior of the chamber 14 between the upper surface 107 and the lower surface 108. Internal support structures, such as baffles 102, 106 can comprise the same material as the chamber panels, or some other generally flexible sheet material. Such structures can be coupled within the chamber, for example, by stitch, adhesive bond, heat bond, or some combination thereof.

Baffles 102, 106 can be arranged to provide ideal firmness under various body portions. More specifically, an upper body portion 110 at the forward end 34 of the chamber and a leg portion 114 at the rearward end 38 of the chamber are provided. As can be seen in the embodiment of FIG. 4, leg portion 114 can be generally flat providing greater firmness so the user can more easily mount and dismount the floatation device. The upper body portion 110, by contrast, can include less internal structuring to allow the chamber to inflate more in this region and present a more rounded, convex profile. Such a profile can provide more cushioning and a softer surface for the user's upper body. Moreover, in some preferred embodiments, the baffles 102, 106 have been arranged to provide a generally flat portion 118 adjacent the abdomen cavity 18. This flat portion 118 provides the user some stability about the cavity thereby reducing the feeling that the user is slipping into the cavity. Of course, one having ordinary skill in the art can appreciate various arrangements of baffles or other internal support structures that can provide similar function as the arrangements depicted in the figures.

Figure 5:
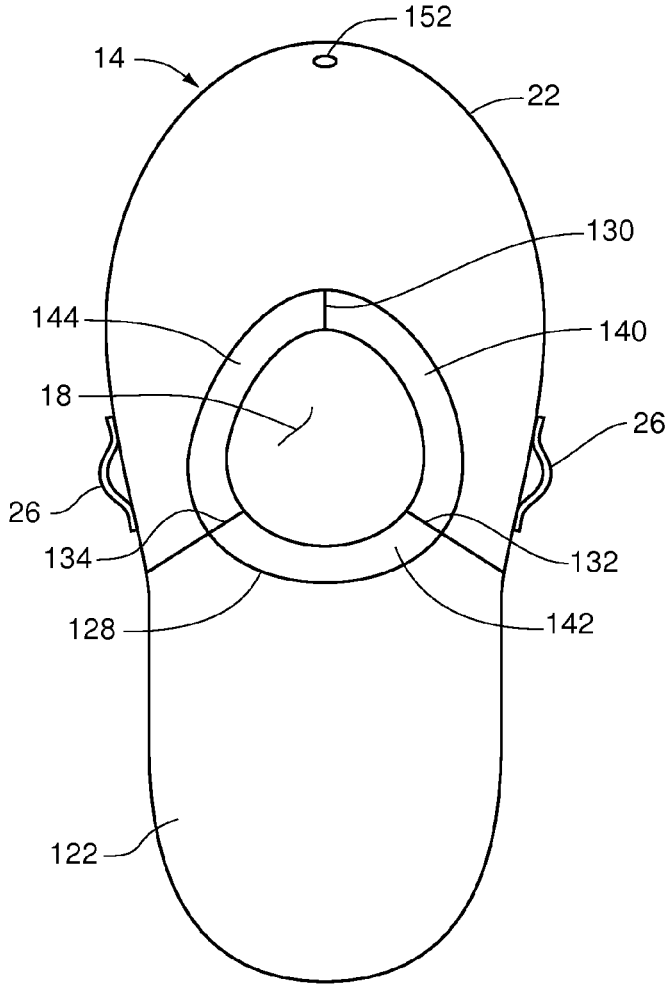
FIG. 5 is a top plan view of an embodiment of the invention including a cover.

To further increase the comfort level provided by the device, some embodiments include a cover. For example, the embodiments shown in FIGS. 2, 5, and 6, can be seen to include a cover 22 adapted to encase the chamber 14, such that cover 22 is closely fitted to the chamber when the chamber is inflated. In particular, the manner in which the cover 22 fits about the cavity 18 can be important to the comfort level provided. A cover that bunches up about the cavity can irritate a user's skin when the skin slides over the bumps or undulations in the cover. Therefore, as can be seen in FIG. 5, the cover 22 should be smooth as it passes over rim of the cavity 18, and tight against the chamber at this location so as to reduce irritation from the cover itself and press down and smooth out any chamber seams underneath.

A cover, according to embodiments of the invention, can comprise a plurality of cover panels 122, 124 joined at cover seams 126, 128, 130, 132, 134. In some embodiments, the cover panels 122, 124 are arranged such that when the cover is installed about the chamber 14, the cover seams joining the panels do not align with the underlying chamber panel seams. In particular, embodiments can arrange cover panel seams 126 so they do not align with chamber cavity seams. For example, in the embodiment of FIG. 5, the cover 22 includes three cavity panels 140, 142, 144 that are joined to major cover panel 122 at cover seam 128, and each other at cover cavity seams 130, 132, 134. Cover seam 128 can be set back from the rim of the cavity 18 such that the seam does not align with the underlying chamber panel seams (not visible here, however, in locations generally corresponding with the chamber cavity seams 148 of FIG. 1). Thus, cover material forms a contiguous, seamless sheet when passing along the cavity surface from the upper chamber surface to the lower chamber surface. This seamless presentation of cover material at points of high contact between the user's skin and the floatation device increases the comfort level afforded the user. Additionally, the cover seams of the embodiment of FIG. 5 are located about the cavity in areas of little contact between the user's skin and the floatation device. More specifically, the cover cavity seams 130, 132, 134 can be positioned in the minor arc radius portions of the cavity 18. Here, the vertically oriented seams are less likely to contact the user's skin and therefore cause less irritation.

A suitable cover material should be soft to the touch and generally agreeable with human skin. In addition to comfort benefits, a cover can help increase the durability of the floatation device by providing a protective outer layer to help to preserve the integrity of the air-impermeable chamber. In some embodiments, the cover material comprises Nylon or Rip stop Nylon. Moreover, a cover can comprise more than one material, for example, cover cavity panels can be made from a different material than major cover panels. Additionally, a cover need not cover the entire surface of the chamber. For example, in some embodiments, the cover only covers the top surface. Also, some embodiments include holes in the cover for access to features coupled with the chamber below such as handles or valves (see e.g. valve hole 152 in FIG. 5).

A cover may be removable and include some attachment mechanism, preferably on the bottom surface or the sides so as not to interfere with user comfort. Suitable attachment mechanisms can include zippers, snaps, buttons, hook-and-loop fasteners, or other fasteners. Alternatively, in some embodiments, the cover may be fixedly attached to or about the chamber by any suitable means.

Figure 6:
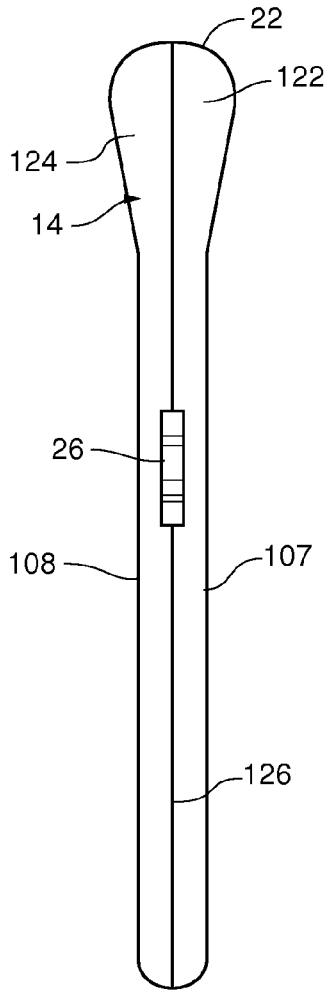
FIG. 6 is a side plan view of an embodiment of the invention including a cover.

FIG. 6 shows that some embodiments can include one or more handles 26. Handles can be located on the sides of the floatation device and can be used to transport the device outside of the water and provide a grip for mounting the device while in the water. Handles can be coupled to the chamber, or to an overlying cover (as in FIG. 6). A handle can comprise any suitable material such as, for example, vinyl, PVC, Nylon, or Rip stop Nylon and can be attached to the cover or chamber by any suitable means, such as by stitch, adhesive bond, heat bond, or some combination thereof. Some embodiments include two handles generally centered lengthwise along the longitudinal sides of the device.

In some embodiments, it is desirable for the chamber to be dimensioned for one user. A device sized for a single user, can be easily transported by that user to a pool, lake or other water source when inflated. For example, an appropriately narrow floatation device having a handle on at least one side can allow a user to carry the device by grabbing a single handle with one hand and holding the device at her side. Thus, in some embodiments the width dimension of the chamber can be between 24 inches and 40 inches. In some embodiments, the width dimension can be approximately 33 inches. Appropriate length dimensions can vary, and can affect the comfort provided to a user, both during transport, and while in the water. Notably, a device that is too long, is more difficult to maneuver within the water by kicking. A device that is too short can be difficult to mount and may not provide appropriate support for the user's body. With these considerations in mind, device length dimensions can range from 50 inches to 90 inches. In some embodiments, the floatation device is approximately 72 inches in length.

Embodiments of the floatation device can further include a valve for inflating and deflating the chamber. For example, in FIG. 1, a valve 156 is disposed at the forward end 34 of the chamber 14. A valve can be disposed anywhere about the outer surface of the chamber. Preferably, the valve is located on a side or bottom surface of the chamber to minimize contact with a user using the device. In some embodiments, the valve can be an easy shut-off valve, as known in the art, to provide ease of inflation for the user.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations, which fall within the spirit and broad scope of the invention.

What is claimed is:

1. A floatation device comprising:

an inflatable chamber having a forward end, a rearward end, sides, an upper surface, and a lower surface, the inflatable chamber comprising at least one major panel and at least one cavity panel; and a cover, wherein the major panel surrounds the cavity panel and the major panel joins the cavity panel at cavity seams;

wherein the cavity panel defines an abdomen cavity extending through the upper and lower surfaces of the inflatable chamber, the abdomen cavity defining a base end adjacent the rearward end of the inflatable chamber and a tapered end adjacent the forward end of the inflatable chamber, wherein the abdomen cavity is symmetrical about a longitudinal centerline of the inflatable chamber so as to define a first half extending clockwise between the base end and the tapered end and a second half extending counterclockwise between the base end and the tapered end, and wherein the first half and the second half each defines a shape that transitions from a first major radius at the base end to a first minor radius to a second major radius to a second minor radius at the tapered end; and wherein the cover is fitted about the abdomen cavity.

2. The floatation device of claim 1, wherein the at least one panel includes two major panels joined at seams and the at least one cavity panel includes two cavity panels joined to the major panels.

3. The floatation device of claim 1, wherein the major panel and the cavity panel comprise a generally air impermeable material.

4. The floatation device of claim 3, wherein the generally air impermeable material comprises vinyl.

5. The floatation device of claim 1, wherein the cover comprises a plurality of cover panels joined at cover seems.

6. The floatation device of claim 5, wherein the cover material comprises Nylon.

7. The floatation device of claim 5, further comprising one or more handles coupled to the cover along the sides.

8. The floatation device of claim 1, wherein the abdomen cavity is generally centrally located relative to the sides and the abdomen cavity is located closer to the forward end than the rearward end of the inflatable chamber along a length of the inflatable chamber.

9. The floatation device of claim 1, further comprising a plurality of internal support structures coupled between the upper surface and the lower surface to contour the floatation device, wherein the plurality of internal support structures are configured to contour the floatation device and provide shape integrity.

10. The floatation device of claim 9, wherein the internal support structures are positioned to provide a leg portion at the rearward end of the inflatable chamber, and an upper body portion at the forward end of the inflatable chamber.

11. The floatation device of claim 1, further comprising one or more handles located on the sides.

12. The floatation device of claim 1, further comprising a valve disposed within a panel of the inflatable chamber for inflating and deflating the floatation device.

13. The floatation device of claim 1, wherein the cover comprises a plurality of cover panels joined at cover seems, and the cover seams are arranged so the cover seams do not overlap the cavity seams.

* * * * *